US008358247B2

(12) United States Patent
Chiu et al.

(10) Patent No.: US 8,358,247 B2
(45) Date of Patent: Jan. 22, 2013

(54) TWIN-VEE-TYPE DUAL BAND ANTENNA

(75) Inventors: Chieh-Ping Chiu, Erlun Township (TW); Feng-Jen Weng, Tao Yuan Shien (TW); I-Ping Yen, Yonghe (TW); Hsiao-Wei Wu, Zhongli (TW)

(73) Assignee: Quanta Computer Inc., Tao Yuan Shien (TW)

( * ) Notice: Subject to any disclaimer, the term of this patent is extended or adjusted under 35 U.S.C. 154(b) by 321 days.

(21) Appl. No.: 12/939,060

(22) Filed: Nov. 3, 2010

(65) Prior Publication Data

US 2011/0309984 A1 Dec. 22, 2011

(30) Foreign Application Priority Data

Jun. 18, 2010 (TW) ..... 99119914 A

(51) Int. Cl.
*H01Q 1/38* (2006.01)
*H01Q 9/28* (2006.01)

(52) U.S. Cl. ..... 343/700 MS; 343/808; 343/809

(58) Field of Classification Search ..... 343/700 MS, 343/808, 809
See application file for complete search history.

(56) References Cited

U.S. PATENT DOCUMENTS

| | | | | |
|---|---|---|---|---|
| 7,050,013 | B2 * | 5/2006 | Kim et al. | 343/770 |
| 7,782,260 | B2 * | 8/2010 | Tsai et al. | 343/700 MS |
| 2010/0231464 | A1 * | 9/2010 | Huang et al. | 343/702 |

* cited by examiner

*Primary Examiner* — Hoang V Nguyen
(74) *Attorney, Agent, or Firm* — Steptoe & Johnson LLP

(57) ABSTRACT

A twin-Vee-type dual band antenna includes interconnected first and second conductor arms and interconnected first and second mirroring conductor arms disposed on a substrate. The second conductor arm has a radiator section extending parallel to the first conductor arm. The first mirroring conductor arm is symmetrical to the first conductor arm, and forms an angle (θ) of less than 180 degrees with the first conductor arm. The second mirroring conductor arm is symmetrical to the second conductor arm, and has a radiator section extending parallel to the first mirroring conductor arm.

14 Claims, 8 Drawing Sheets

TWIN-VEE-TYPE DUAL BAND ANTENNA

CROSS-REFERENCE TO RELATED APPLICATION

This application claims priority of Taiwanese Application No. 099119914, filed on Jun. 18, 2010.

BACKGROUND OF THE INVENTION

1. Field of the Invention

The present invention relates to a dual band antenna, more particularly to an external twin-Vee-type dual band antenna.

2. Description of the Related Art

External antennas are designed for high gain since they are mainly used to improve reception of wireless signals by wireless devices. However, omni-directionality of radiation pattern of the external antenna is compromised in achieving the high gain of the antenna. Therefore, the external antennas generally have high gain and low omni-directionality.

FIG. 1 and FIG. 2 are schematic diagrams illustrating opposite sides of a conventional omnidirectional antenna 100 that has open-loop dipole antennas cascaded for boosting gain. The conventional omnidirectional antenna 100 includes an antenna substrate 1 having a front surface and a rear surface opposite to the front surface. A first feed-in portion 10*a*, a first metal line 11 and a first radiator unit 20 are disposed on the front surface of the antenna substrate 1. A second feed-in portion 10*b*, a second metal line 12 and a second radiator unit 30 are disposed on the rear surface of the antenna substrate 1.

Each of the first metal line 11 and the second metal line 12 is increased in width for improving impedance matching of a corresponding one of the cascaded first and second radiator units 20, 30. Nevertheless, increasing the widths of the first and second metal lines 11, 12 will result in reduced spacing between the first metal line 11 and the first radiator unit 20, and between the second metal line 12 and the second radiator unit 30. Correspondingly, signals transmitted through the metal lines 11, 12 may be coupled electromagnetically to the first and second radiator units 20, 30, which in turn affects impedance matching between the first and second radiator units 20, 30, and limits bandwidth of the conventional omnidirectional antenna 100. However, if spacings between the first metal line 11 and the first radiator unit 20 and between the second metal line 12 and the second radiator unit 30 are increased to result in reduced coupling thereamong, directionality of the antenna 100 will be increased.

SUMMARY OF THE INVENTION

Therefore, an object of the present invention is to provide a twin-Vee-type dual band antenna with high gain and an omnidirectional radiation pattern.

A twin-Vee-type dual band antenna of the present invention includes a substrate, a first conductor arm, a second conductor arm, a first mirroring conductor arm, and a second mirroring conductor arm.

The first conductor arm is disposed on the substrate and has a grounding end. The second conductor arm is disposed on the substrate and has a first radiator section and a second radiator section. The first radiator section has a first end connected to the first conductor arm, and a second end. The second radiator section has one end connected to the second end of the first radiator section, and the second radiator section extends parallel to the first conductor arm. The first mirroring conductor arm is disposed on the substrate, and is spaced apart from the first conductor arm. The first mirroring conductor arm is symmetrical to the first conductor arm, and has a length substantially equal to that of the first conductor arm. The first mirroring conductor arm further has a feed-in end adjacent to the grounding end, and forms an angle (θ) of less than 180 degrees with the first conductor arm. The second mirroring conductor arm is disposed on the substrate, and is spaced apart from the second conductor arm. The second mirroring conductor arm is symmetrical to the second conductor arm, and has a length substantially equal to that of the second conductor arm. The second mirroring conductor arm further has a third radiator section and a fourth radiator section. The third radiator section has a first end connected to the first mirroring conductor arm, and a second end. The third radiator section is adjacent and substantially parallel to the first radiator section. The fourth radiator section has one end connected to the second end of the third radiator section. The fourth radiator section extends parallel to the first mirroring conductor arm and is symmetrical to the second radiator section.

Preferably, the length of the first conductor arm is longer than that of the second radiator section of the second conductor arm. The first conductor arm and the first mirroring conductor arm form a first V-shaped resonant path capable of resonating in a first frequency band. The second conductor arm and the second mirroring conductor arm form a second V-shaped resonant path capable of resonating in a second frequency band higher than the first frequency band. Preferably, the first frequency band ranges from 2.5 GHz to 2.7 GHz, and the second frequency band ranges from 3.4 GHz to 3.6 GHz.

The first radiator section and the third radiator section form a first clearance therebetween, and bandwidth and gain of the second frequency band are dependent upon dimensions of the first clearance. The first conductor arm and the second radiator section of the second conductor arm form a second clearance therebetween, and impedance matching of the first and second frequency bands and resonant frequency of the second frequency band are dependent upon dimensions of the second clearance. The second clearance ranges from $(1/30)\lambda_{h0}$ to $(1/5)\lambda_{h0}$, wherein $\lambda_{h0}$ is a vacuum wavelength of the second frequency band.

Preferably, each of the first conductor arm and the first mirroring conductor arm has a first width, and bandwidth of the first frequency band is dependent upon the first width. Moreover, each of the second conductor arm and the second mirroring conductor arm has a second width, and bandwidth of the second frequency band is dependent upon the second width.

Preferably, the twin-Vee-type dual band antenna of the present invention further includes a coaxial transmission cable having a first terminal connected to the feed-in end, and a second terminal connected to the grounding end.

Preferably, the twin-Vee-type dual band antenna of the present invention further includes a balun having one end connected to the first mirroring conductor arm, and another end connected to the second terminal of the coaxial transmission cable.

Preferably, the first V-shaped resonant path has a resonant length substantially equal to 1.5 times wavelength of a center frequency of the first frequency band. The second V-shaped resonant path has a resonant length substantially equal to 1.5 times wavelength of a center frequency of the second frequency band.

Preferably, the angle (θ) is substantially equal to $$\theta = 152\left(\frac{h}{\lambda}\right)^2 - 388\left(\frac{h}{\lambda}\right) + 324$$

for optimum impedance matching, wherein $0.5\lambda \leqq h \leqq 1.5\lambda$, h is the length of the second radiator section of the second conductor arm, and λ is the wavelength of the received or transmitted signal.

Preferably, the length of the first conductor arm is different from that of the second radiator section of the second conductor arm. The first conductor arm and the first mirroring conductor arm form a first V-shaped resonant path capable of resonating in a first frequency band. The second conductor arm and the second mirroring conductor arm form a second V-shaped resonant path capable of resonating in a second frequency band different from the first frequency band.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
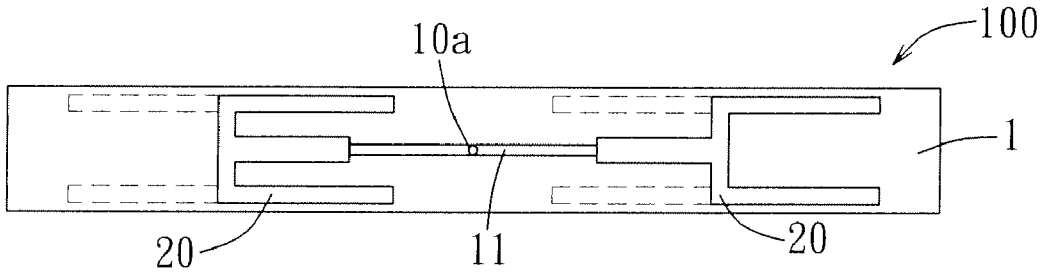
FIG. 1 PRIOR ART
FIG. 1 is a front schematic view of a conventional omni-directional antenna with high gain.
Figure 2:
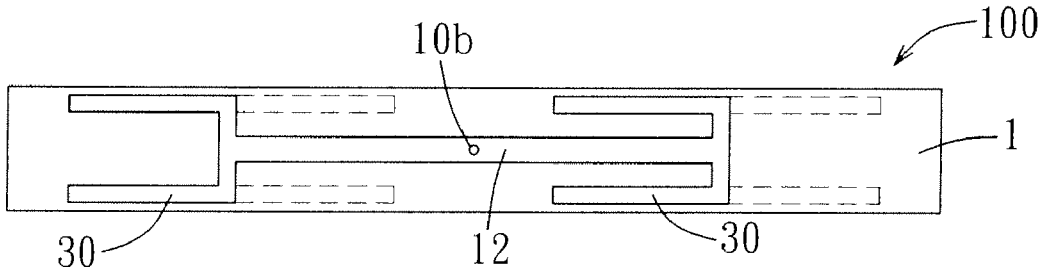
FIG. 2 PRIOR ART
FIG. 2 is a rear schematic view of the conventional omni-directional antenna.
Figure 3:
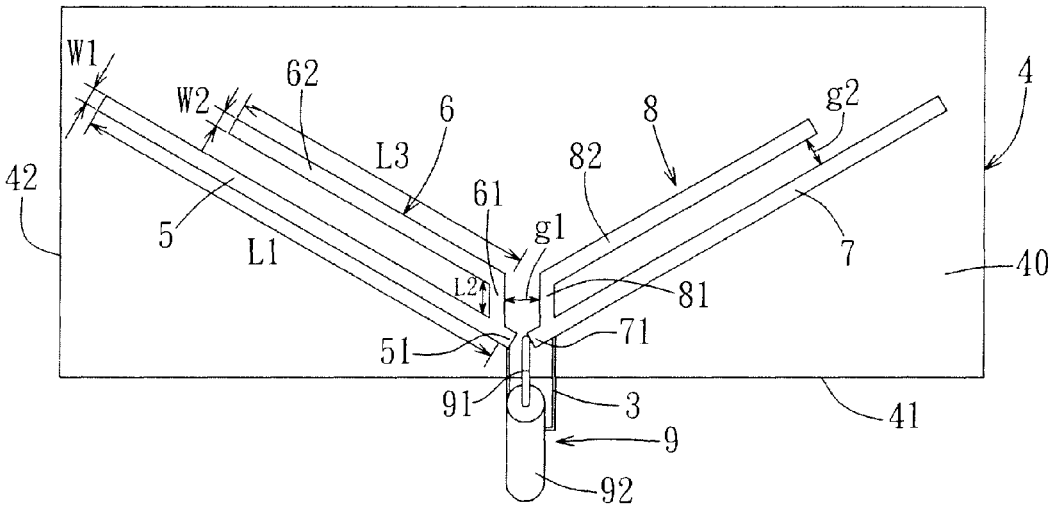
FIG. 3 is a schematic view illustrating a preferred embodiment of a twin-Vee-type dual band antenna of the present invention.

Referring to FIG. 3, a preferred embodiment of the twin-Vee-type dual band antenna of the present invention includes a substrate 4, a first conductor arm 5, a second conductor arm 6, a first mirroring conductor arm 7 and a second mirroring conductor arm 8.

In this embodiment, the substrate 4 is substantially rectangular in shape, and is a microwave substrate. However, the shape and the type of the substrate 4 are not limited to the disclosure of this embodiment.

The first conductor arm 5 is disposed on a surface 40 of the substrate 4, and extends diagonally from a central section adjacent to a long side 41 toward a short side 42 of the substrate 4. The first conductor arm 5 has a grounding end 51 adjacent to the long side 41. In this embodiment, the first conductor arm 5 is a long and straight conducting wire, and has a first length (L1) and a first width (W1).

The second conductor arm 6 is disposed on the surface 40 of the substrate 4, and has a first radiator section 61 and a second radiator section 62. The first radiator section 61 is a long and straight conducting wire, and has a second length (L2) and a second width (W2). The first radiator section 61 is substantially perpendicular to the long side 41 of the substrate 4, and has a first end connected to the first conductor arm 5 and adjacent to the grounding end 51, and an opposite second end. The second radiator section 62 is a long and straight conducting wire, and has a third length (L3) and a width substantially equal to the second width (W2) of the first radiator section 61. The second radiator arm 62 has one end connected to the second end of the first conductor arm 61, is substantially parallel to the first conductor arm 5, and is disposed on one side of the first conductor arm 5 opposite to the long side 41 of the substrate 4. In this embodiment, the first length (L1) is longer than the second length (L2) and the third length (L3), and the third length (L3) is longer than the second length (L2).

The first mirroring conductor arm 7 is a long and straight conducting wire, and is disposed on the surface 40 of the substrate 4. The first mirroring conductor arm 7 is spaced apart from the first conductor arm 5, is symmetrical to the first conductor arm 5, and has a length substantially equal to the first length (L1) of the first conductor arm 5. The first mirroring conductor arm 7 further has a feed-in end 71 adjacent to the grounding end 51, and forms an angle (θ) of less than 180 degrees with the first conductor arm 5. The first mirroring conductor arm 7 further has a width substantially equal to the first width (W1) of the first conductor arm 5.

The second mirroring conductor arm 8 is disposed on the surface 40 of the substrate 4. The second mirroring conductor arm 8 is spaced apart from the second conductor arm 6, is symmetrical to the second conductor arm 6, and has a length substantially equal to that of the second conductor arm 6. The second mirroring conductor arm 8 has a third radiator section 81 and a fourth radiator section 82. The third radiator section 81 is substantially perpendicular to the long side 41 of the substrate 4, and has a length and a width substantially equal to the second length (L2) and the second width (W2) of the first radiator section 61. The third radiator section 81 has a first end connected to the first mirroring conductor arm 7, and an opposite second end. The third radiator section 81 is adjacent to and substantially parallel to the first radiator arm 61. The fourth radiator section 82 is a long and straight conducting wire, and has a length and a width substantially equal to the third length (L3) and the second width (W2) of the second radiator section 62. The fourth radiator arm 82 has one end connected to the second end of the third conductor arm 81, is substantially parallel to the first mirroring conductor arm 7, and is disposed on one side of the first mirroring conductor arm 7 opposite to the long side 41 of the substrate 4. The fourth radiator arm 82 is symmetrical to the second radiator arm 62.

According to the structure described above, the first conductor arm 5 and the first mirroring conductor arm 7 cooperate to form a first V-shaped resonant path capable of resonating in a first frequency band in a manner similar to a dipole antenna. The first frequency band of this embodiment ranges from 2.5 GHz to 2.7 GHz, and the first V-shaped resonant path has a resonant length substantially equal to 1.5 times the wavelength of a center frequency equal to 2.6 GHz.

The second conductor arm 6 and the second mirroring conductor arm 8 cooperate to form a second V-shaped resonant path capable of resonating in a second frequency band in a manner similar to a dipole antenna. The second frequency band in this embodiment ranges from 3.4 GHz to 3.6 GHz, and the second V-shaped resonant path has a resonant length substantially equal to 1.5 times the wavelength of a center frequency equal to 3.5 GHz.

The angle (θ) is substantially equal to $$\theta = 152\left(\frac{h}{\lambda}\right)^2 - 388\left(\frac{h}{\lambda}\right) + 324$$

for optimum impedance matching, wherein $0.5\lambda \leqq h \leqq 1.5\lambda$, h is the length (L3) of the second radiator section 62 of the second conductor arm 6, and λ is the wavelength of the received or transmitted signal.

Furthermore, the first radiator section 61 and the third radiator section 81 form a clearance (g1) therebetween. The first conductor arm 5 and the second radiator section 62 of the second conductor arm 6 form a second clearance (g2) therebetween. The first mirroring conductor arm 7 and the second mirroring conductor arm 8 also form the same clearance (g2). The bandwidth and the gain of the second frequency band may be adjusted by varying the dimensions of the first clearance (g1). For example, reducing the first clearance (g1), i.e., moving the first radiator section 61 toward the grounding end 51 and moving the third radiator section 81 toward the feed-in end 71, can increase the gain and the bandwidth of the second frequency band. Preferably, the second clearance (g2) ranges from $(1/30)\lambda_{h0}$ to $(1/5)\lambda_{h0}$, wherein $\lambda_{h0}$ is a vacuum wavelength of the second frequency band.

Moreover, the bandwidth of the first frequency band may be fine-tuned by varying the first width (W1). The bandwidth of the second frequency band may be fine-tuned by varying the second width (W2).

Therefore, after deciding on the lengths of the conductor arms to correspond to the desired resonant frequencies, the angle (θ), the first clearance (g1) and the second clearance (g2) are adjusted for optimum impedance matching and bandwidth.

The detailed dimensions of the twin-Vee-type dual band antenna of this embodiment are listed in Table 1 below.

TABLE 1

| | L1 | L2 | θ | W1 | W2 | g1 | g2 |
|---|---|---|---|---|---|---|---|
| Unit: (mm) | 72 | 48.5 | 113° | 2.5 | 2.5 | 4.5 | 3 |

Referring once more to FIG. 3, the twin-Vee-type dual band antenna of this embodiment further includes a coaxial transmission cable 9 and a balanced-to-unbalanced transformer (hereinafter referred to as balun) 3. The coaxial transmission cable has a first terminal (i.e., inner conductor) 91 electrically connected to the feed-in end 71, and a second terminal (i.e., external conductor) 92 electrically connected to the grounding end 51. The balun 3 has one end connected to the first mirroring conductor arm 7 and adjacent to the feed-in end 71, and another end connected to the second terminal 92 of the coaxial transmission cable 9 for neutralizing static electricity of the second terminal (i.e., external conductor) 92 of the coaxial transmission cable 9 so as to minimize the influence of the coaxial transmission cable 9 on antenna radiation. Preferably, the length of the balun 3 is approximately a quarter wavelength of the center frequency (i.e., 3 GHz) of the first and second frequency bands.

Figure 4:
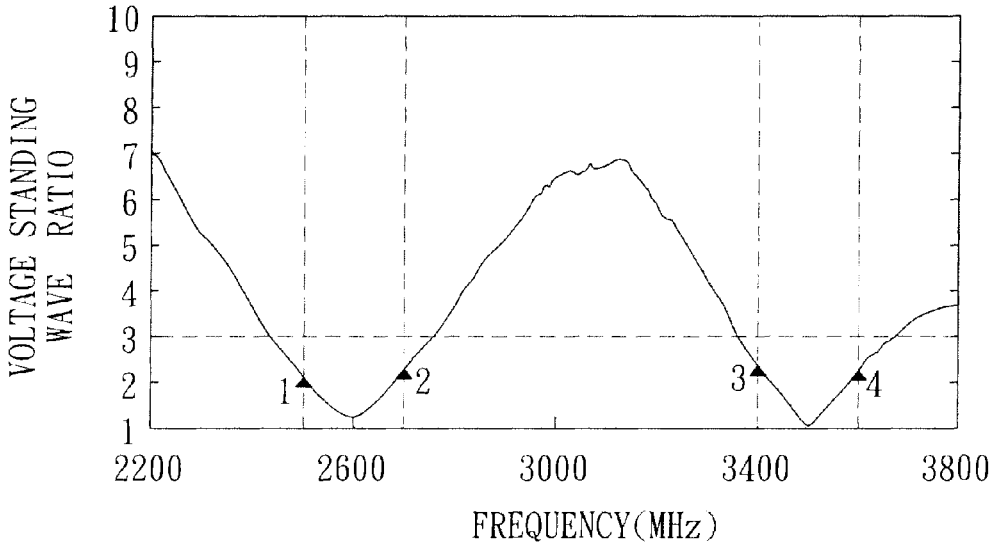
FIG. 4 is a Voltage Standing Wave Ratio (VSWR) plot showing VSWR values of the preferred embodiment.
Figure 5:
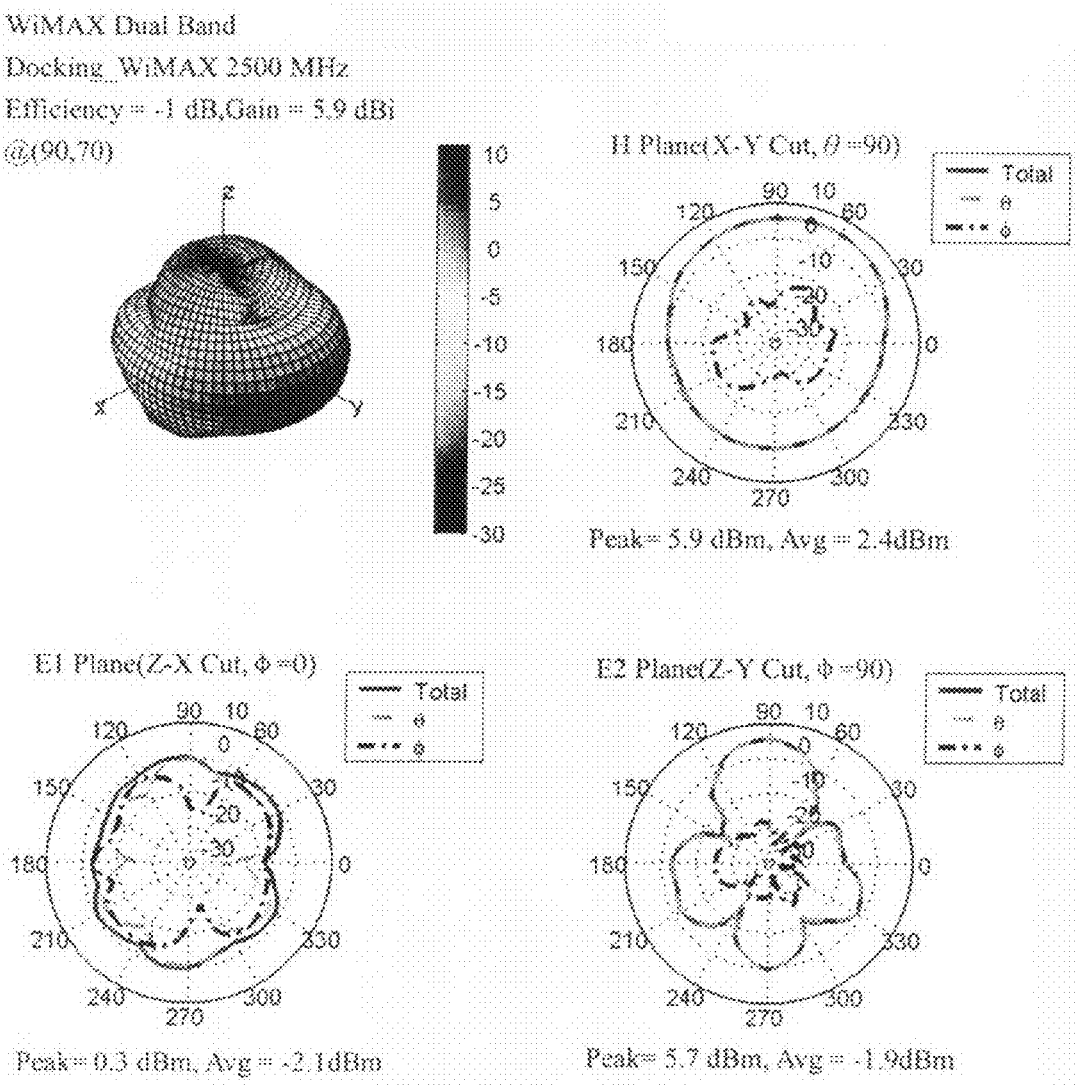
FIG. 5 illustrates radiation patterns of the preferred embodiment operating at 2500 MHz.
Figure 6:
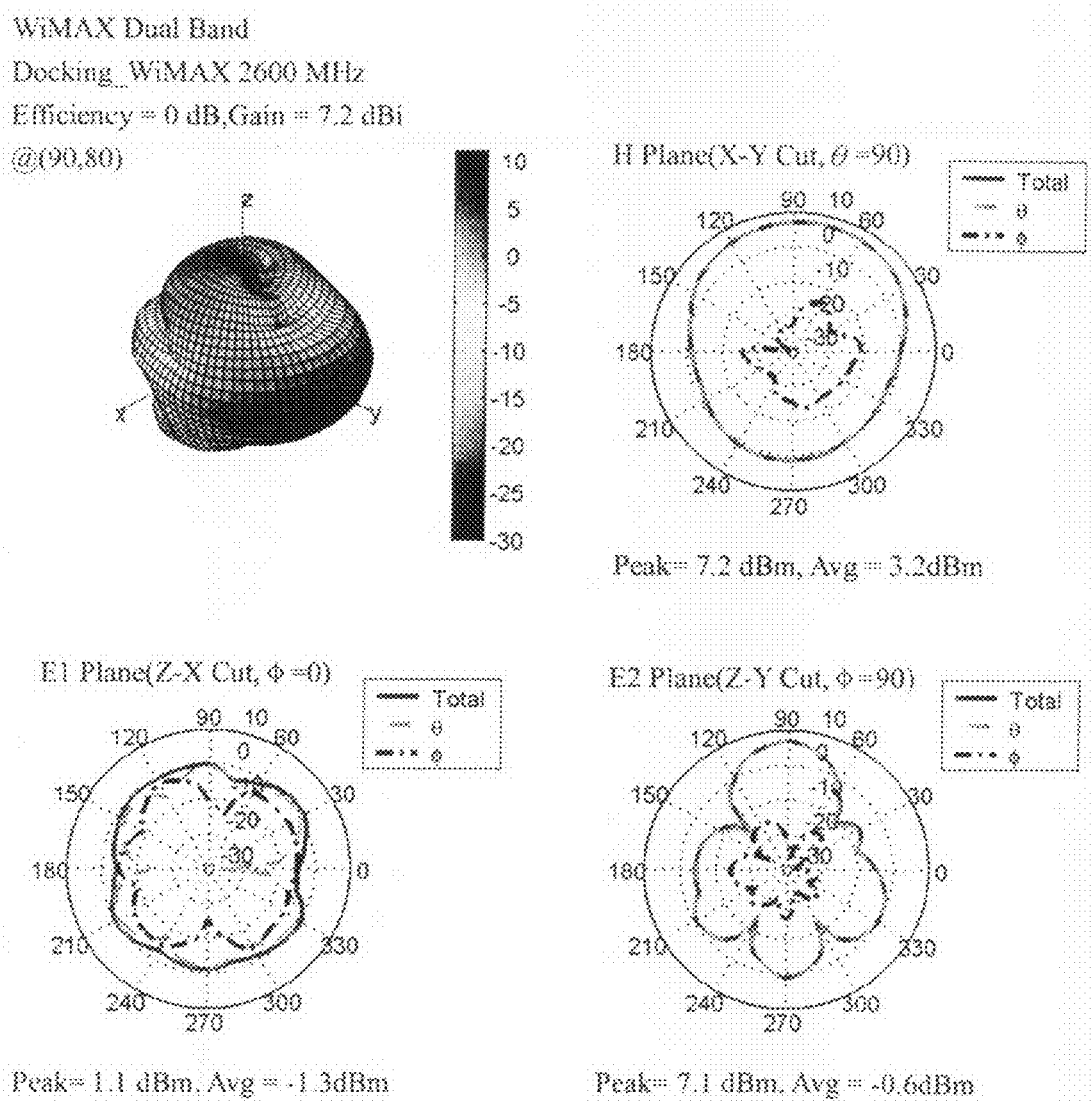
FIG. 6 illustrates radiation patterns of the preferred embodiment operating at 2600 MHz.
Figure 7:
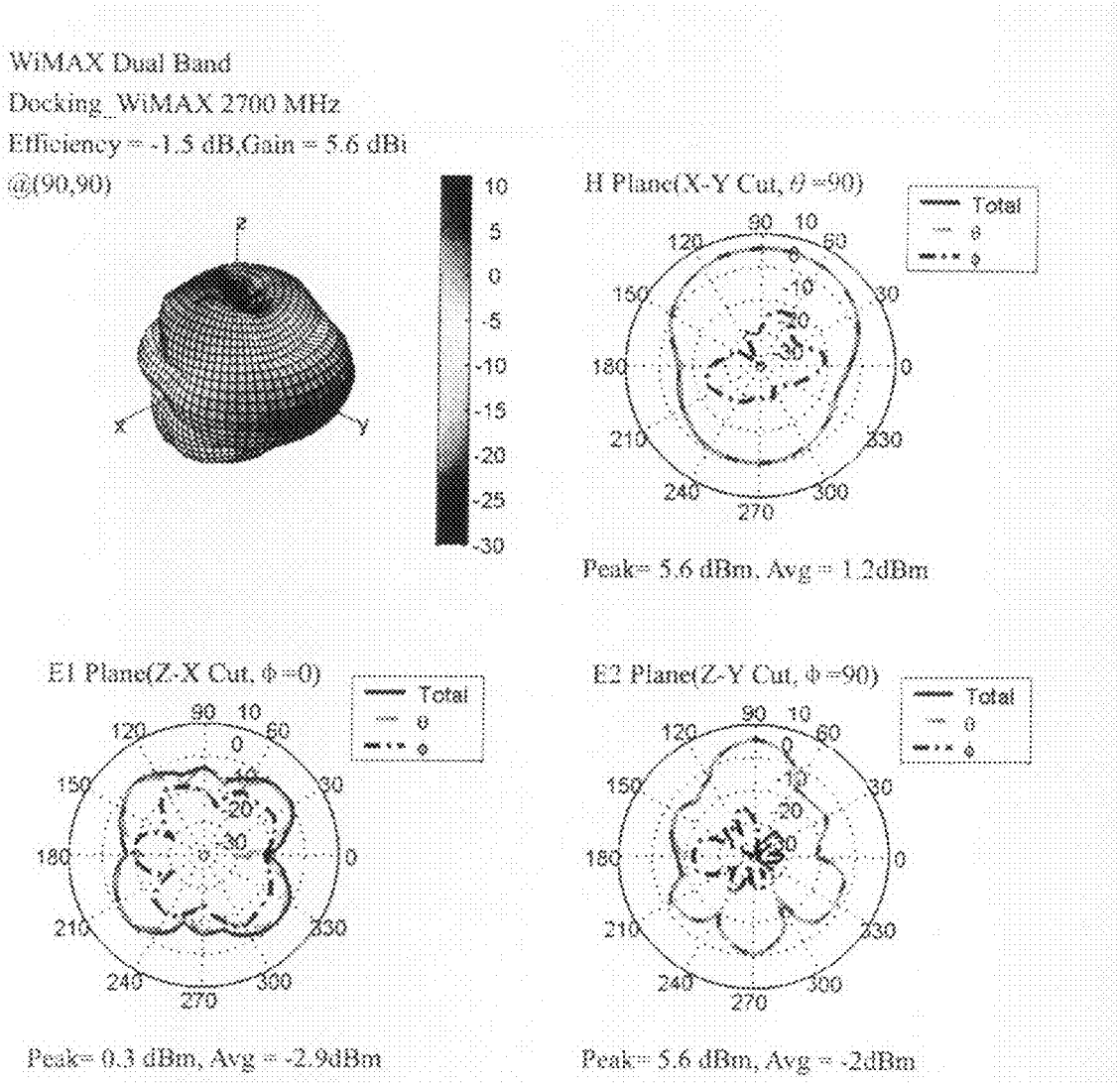
FIG. 7 illustrates radiation patterns of the preferred embodiment operating at 2700 MHz.
Figure 8:
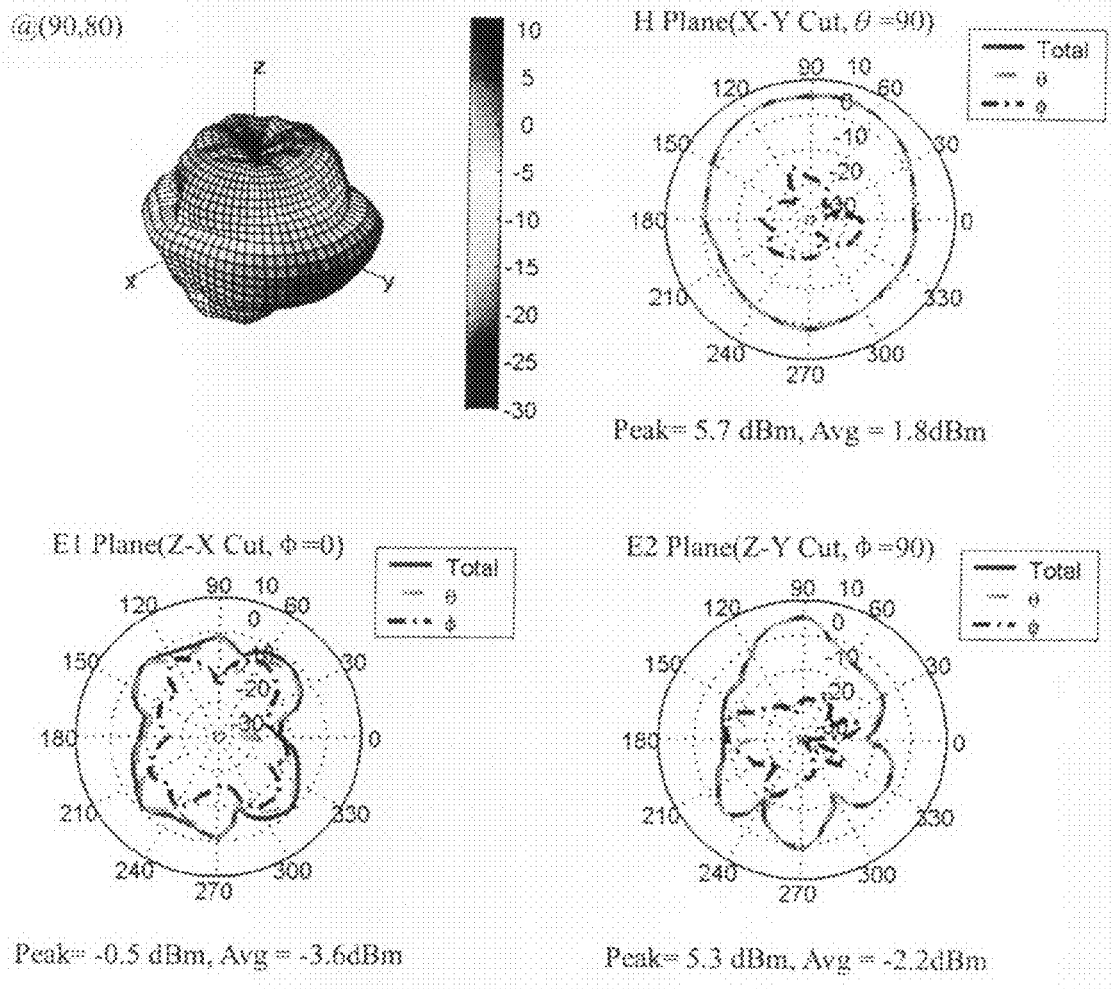
FIG. 8 illustrates radiation patterns of the preferred embodiment operating at 3400 MHz.
Figure 9:
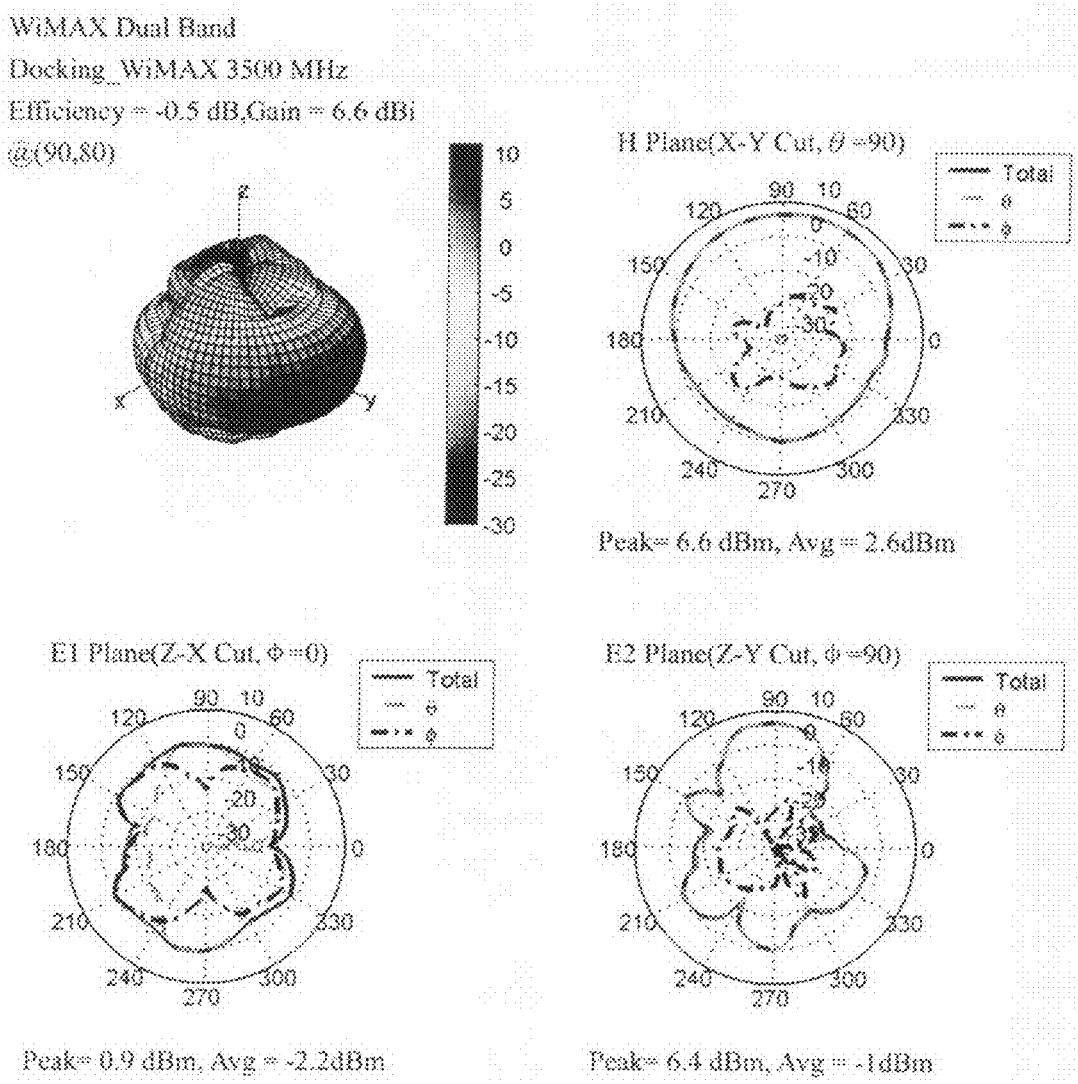
FIG. 9 illustrates radiation patterns of the preferred embodiment operating at 3500 MHz.
Figure 10:
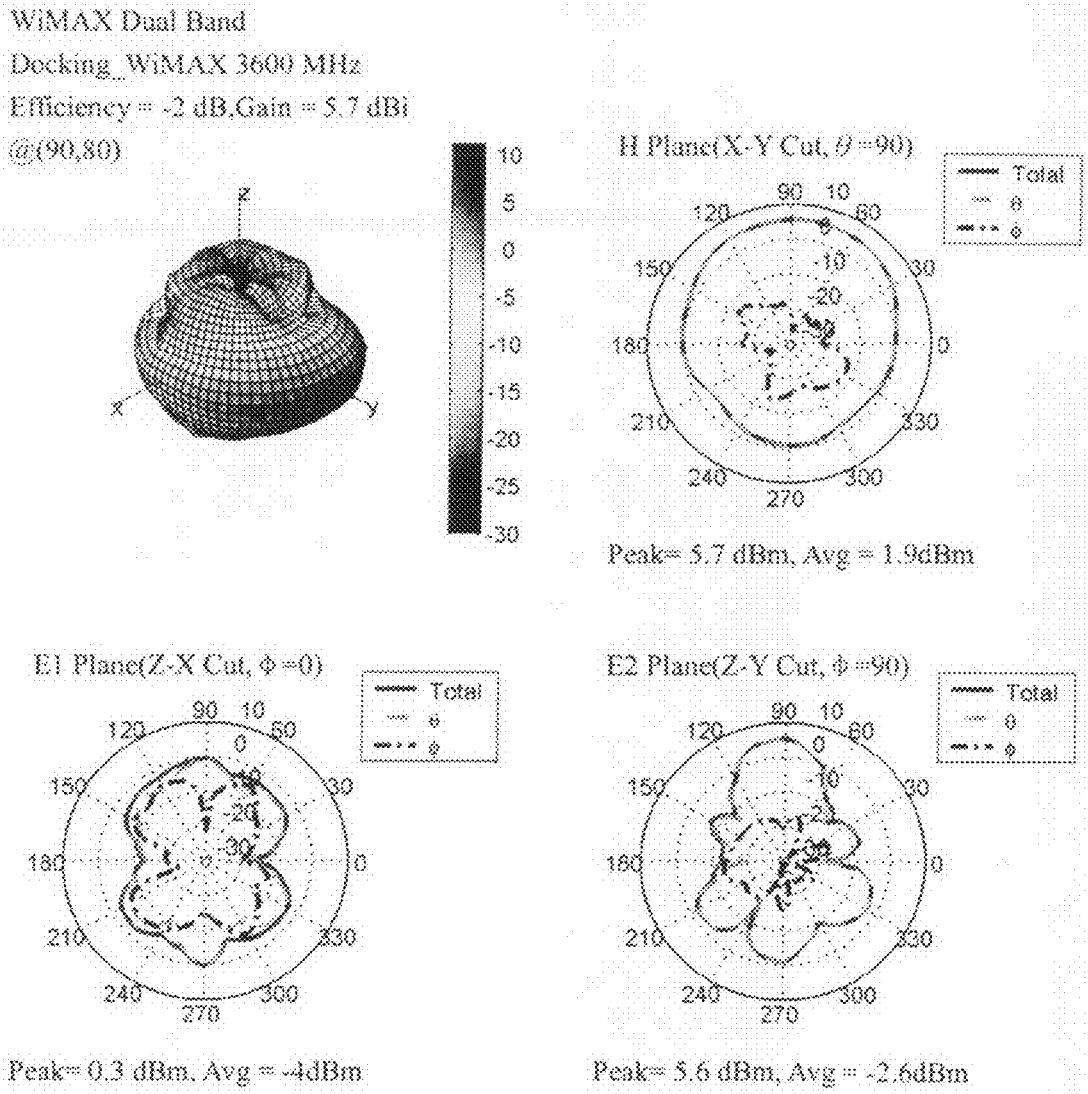
FIG. 10 illustrates radiation patterns of the preferred embodiment operating at 3600 MHz.

Referring to FIG. 4, which is a voltage standing wave ratio (VSWR) plot of this embodiment, the VSWR values of the twin-Vee-type dual band antenna of this embodiment at frequencies within the first frequency band ranging from 2.5 GHz to 2.7 GHz and the second frequency band ranging from 3.4 GHz to 3.6 GHz are smaller than 2.5:1. According to Table 2 below, the efficiency of the twin-Vee-type dual band antenna of this embodiment at frequencies within the first and second frequency bands is greater than 50%, and the maximum gains are 7.2 dBi and 6.6 dBi, respectively. In addition, the gains at frequencies within the first and second frequency bands are all greater than 5 dBi.

TABLE 2

| WiMAX | Frequency (MHz) | Efficiency (dB) | Gain (dBi) |
|---|---|---|---|
| 2.5~2.7 GHz | 2500 | −1.0 | 5.9 |
| | 2550 | −0.4 | 6.7 |
| | 2600 | −0.0 | 7.2 |
| | 2650 | −1.0 | 6.1 |
| | 2700 | −1.5 | 5.6 |
| 3.4~3.6 GHZ | 3400 | −1.8 | 5.6 |
| | 3500 | −0.5 | 6.6 |
| | 3600 | −2.0 | 5.7 |

Referring to Table 3 below, the parameters of the omnidirectionality of the twin-Vee-type dual band antenna of this embodiment are listed. The peak-to-valley ratios at the first and second frequency bands are smaller than 11.5 dB and 10.5 dB, respectively, and the forward/backward radiation ratios at the first and second frequency bands are all smaller than 7 dB.

TABLE 3

| WiMAX | Frequency (MHz) | Peak-to-Valley Ratio (dB) | Forward/Backward Radiation Ratio (dB) |
|---|---|---|---|
| 2.5~2.7 GHz | 2500 | 7.8 | 5.4 |
| | 2550 | 8.8 | 5.6 |
| | 2600 | 9.6 | 5.9 |
| | 2650 | 10.7 | 5.5 |
| | 2700 | 11.2 | 5.8 |
| 3.4~3.6 GHz | 3400 | 8.9 | 3.7 |
| | 3500 | 9.4 | 6.3 |
| | 3600 | 10.2 | 6.6 |

Referring to FIG. 5 to FIG. 10, which illustrate the radiation patterns of the twin-Vee-type dual band antenna, the X-Y planes of the radiation patterns at the first and second frequency bands are generally circular, i.e., the twin-Vee-type dual band antenna is highly omnidirectional.

In summary, the twin-Vee-type dual band antenna of this embodiment can operate in dual band, and has high gain, high omni-directionality and a simple structure.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A twin-Vee-type dual band antenna comprising:

a substrate;

a first conductor arm disposed on said substrate and having a grounding end;

a second conductor arm disposed on said substrate and having a first radiator section having a first end connected to said first conductor arm, and a second end, and a second radiator section having one end connected to said second end of said first radiator section, said second radiator section extending parallel to said first conductor arm;

a first mirroring conductor arm disposed on said substrate, said first mirroring conductor arm being spaced apart from said first conductor arm, being symmetrical to said first conductor arm, and having a length substantially equal to that of said first conductor arm, said first mirroring conductor arm further having a feed-in end adjacent to said grounding end, and forming an angle (θ) of less than 180 degrees with said first conductor arm; and a second mirroring conductor arm disposed on said substrate, said second mirroring conductor arm being spaced apart from said second conductor arm, being symmetrical to said second conductor arm, and having a length substantially equal to that of said second conductor arm, said second mirroring conductor arm further having a third radiator section having a first end connected to said first mirroring conductor arm, and a second end, said third radiator section being adjacent and substantially parallel to said first radiator section, and a fourth radiator section having one end connected to said second end of said third radiator section, said fourth radiator section extending parallel to said first mirroring conductor arm and being symmetrical to said second radiator section.

2. The twin-Vee-type dual band antenna as claimed in claim 1, wherein the length of said first conductor arm is longer than that of said second radiator section of said second conductor arm, said first conductor arm and said first mirroring conductor arm forming a first V-shaped resonant path capable of resonating in a first frequency band, said second conductor arm and said second mirroring conductor arm forming a second V-shaped resonant path capable of resonating in a second frequency band higher than the first frequency band.

3. The twin-Vee-type dual band antenna as claimed in claim 2, wherein:

said first radiator section and said third radiator section form a first clearance therebetween, bandwidth and gain of the second frequency band being dependent upon dimensions of said first clearance; and said first conductor arm and said second radiator section of said second conductor arm form a second clearance therebetween, impedance matching of the first and second frequency bands and resonant frequency of the second frequency band being dependent upon dimensions of said second clearance, said second clearance ranging from $(1/30)\lambda_{h0}$ to $(1/5)\lambda_{h0}$, wherein $\lambda_{h0}$ is a vacuum wavelength of the second frequency band.

4. The twin-Vee-type dual band antenna as claimed in claim 3, wherein the first frequency band ranges from 2.5 GHz to 2.7 GHz, and the second frequency band ranges from 3.4 GHz to 3.6 GHz.

5. The twin-Vee-type dual band antenna as claimed in claim 2, wherein:

each of said first conductor arm and said first mirroring conductor arm has a first width, bandwidth of the first frequency band being dependent upon said first width; and each of said second conductor arm and said second mirroring conductor arm has a second width, bandwidth of the second frequency band being dependent upon said second width.

6. The twin-Vee-type dual band antenna as claimed in claim 2, further comprising a coaxial transmission cable having a first terminal connected to said feed-in end, and a second terminal connected to said grounding end.

7. The twin-Vee-type dual band antenna as claimed in claim 6, further comprising a balun having one end connected to said first mirroring conductor arm, and another end connected to said second terminal of said coaxial transmission cable.

8. The twin-Vee-type dual band antenna as claimed in claim 2, wherein:

said first V-shaped resonant path has a resonant length substantially equal to 1.5 times wavelength of a center frequency of the first frequency band; and said second V-shaped resonant path has a resonant length substantially equal to 1.5 times wavelength of a center frequency of the second frequency band.

9. The twin-Vee-type dual band antenna as claimed in claim 8, wherein the angle (θ) is substantially equal to $$\theta = 152\left(\frac{h}{\lambda}\right)^2 - 388\left(\frac{h}{\lambda}\right) + 324,$$

and wherein $0.5\lambda \leqq h \leqq 1.5\lambda$, h is the length of said second radiator section of said second conductor arm, and λ is the wavelength of the received or transmitted signal.

10. The twin-Vee-type dual band antenna as claimed in claim 2, wherein said substrate is a microwave substrate.

11. The twin-Vee-type dual band antenna as claimed in claim 1, further comprising a coaxial transmission cable having a first terminal connected to said feed-in end, and a second terminal connected to said grounding end.

12. The twin-Vee-type dual band antenna as claimed in claim 11, further comprising a balun having one end connected to said first mirroring conductor arm, and another end connected to said second terminal of said coaxial transmission cable.

13. The twin-Vee-type dual band antenna as claimed in claim 1, wherein said substrate is a microwave substrate.

14. The twin-Vee-type dual band antenna as claimed in claim 1, wherein the length of said first conductor arm is different from that of said second radiator section of said second conductor arm, said first conductor arm and said first mirroring conductor arm forming a first V-shaped resonant path capable of resonating in a first frequency band, said second conductor arm and said second mirroring conductor arm forming a second V-shaped resonant path capable of resonating in a second frequency band different from the first frequency band.

* * * * *